US008439099B1

(12) United States Patent
Crider

(10) Patent No.: US 8,439,099 B1
(45) Date of Patent: May 14, 2013

(54) DUAL CURTAIN CLOSURE SYSTEM HAVING UNI-DIRECTIONAL SECURING HOOKS

(76) Inventor: Grant W. Crider, Bremen, AL (US)

( * ) Notice: Subject to any disclaimer, the term of this patent is extended or adjusted under 35 U.S.C. 154(b) by 0 days.

(21) Appl. No.: 13/309,238

(22) Filed: Dec. 1, 2011

(51) Int. Cl.
*E06B 9/08* (2006.01)
*E03C 1/33* (2006.01)

(52) U.S. Cl.
USPC ..... 160/121.1; 160/85; 24/306; 24/442

(58) Field of Classification Search ..... 160/85, 160/86, 120, 121.1, 122, 242, 266, 268.1, 160/270, 271, 273.1, 264; 24/306, 442
See application file for complete search history.

(56) References Cited

U.S. PATENT DOCUMENTS

| | | | | |
|---|---|---|---|---|
| 2,717,437 | A * | 9/1955 | De Mestral | 428/92 |
| 3,461,513 | A * | 8/1969 | Hockmeyer et al. | 24/445 |
| 3,594,873 | A * | 7/1971 | Hockmeyer et al. | 24/445 |
| 3,710,425 | A * | 1/1973 | Brumlik | 24/447 |
| 3,943,981 | A * | 3/1976 | De Brabander | 139/391 |
| 4,984,339 | A | 1/1991 | Provost et al. | |
| 5,566,736 | A | 10/1996 | Crider et al. | |
| 5,752,557 | A | 5/1998 | Crider et al. | |
| 5,785,105 | A | 7/1998 | Crider et al. | |
| 5,911,521 | A * | 6/1999 | Steinmetz et al. | 4/633 |
| 5,960,847 | A | 10/1999 | Crider et al. | |
| 6,086,973 | A | 7/2000 | Hazes | |
| 6,138,739 | A | 10/2000 | Crider et al. | |
| 6,942,001 | B1 | 9/2005 | Crider et al. | |
| 7,132,144 | B2 | 11/2006 | Roberts | |
| 7,631,683 | B2 | 12/2009 | Crider | |
| 7,802,607 | B2 | 9/2010 | Crider | |
| 7,828,037 | B2 | 11/2010 | Crider | |
| 8,016,014 | B2 | 9/2011 | Crider et al. | |

* cited by examiner

*Primary Examiner* — Katherine Mitchell
*Assistant Examiner* — Jaime F Cardenas-Garcia
(74) *Attorney, Agent, or Firm* — Kenneth M. Bush; Bush Intellectual Property Law

(57) ABSTRACT

A dual curtain closure system for reversibly covering a portal opening, wherein the upper end of each curtain is attached across an upper margin of the opening and the lower end of each curtain is folded back on itself to form an upwardly opening pocket. Each pocket supports an elongated rod, the ends of which are engaged by opposing channel members defining the lateral margins of the portal opening. The sides of each curtain comprise loop fastening material and the channel members comprise hook fastening material such that the curtains are sealed to the channel members when activated to cover the opening. The hook fastening material has only downwardly facing hooks to prevent curtain hang up and promote proper operation of the closure system.

10 Claims, 6 Drawing Sheets

DUAL CURTAIN CLOSURE SYSTEM HAVING UNI-DIRECTIONAL SECURING HOOKS

FIELD OF THE INVENTION

The present invention relates to closures for windows, doors, or other portals. More particularly, the present invention relates to a dual curtain closure system utilizing hook and loop fastening material to attach roll-up curtains to the lateral margins of a portal.

BACKGROUND OF THE INVENTION

Sealable curtain systems are known in the prior art. One such sealable curtain taught in U.S. Pat. No. 5,566,736 to Crider et al., incorporated herein by reference, and specifically shown in FIG. 5 of the '736 patent, has two curtains, two channel members, and two elongated rods. The channel members are C-shaped and the lateral ends of each elongated rod are slidably secured therein. Each rod is supported by a single curtain and each curtain is designed to form a seal with only the adjacent lateral side of each channel member. Affixed to the longitudinal sides of each curtain and the lateral sides of the channel members are complementary closure members, such as hook and loop fastening material.

Due to the structure of the '736 patent system, when the curtains are not at their bottommost positions, the portion of each longitudinal side of the first curtain having loop fastening material affixed directly thereto abuts almost the entire circumference of the rod captured within the pocket of the first curtain. If an exterior force is applied to the first curtain, the first curtain rod is urged in the same direction. If the exterior force is adequate and in the general direction towards the lateral sides of the channel members not adjacent to the first curtain, the first curtain may detach from the adjacent lateral side of the channel member and attach to the nonadjacent lateral side of the channel member due to the engagement of the loop fastening material affixed to the longitudinal side of the first curtain with the hook fastening material affixed to the nonadjacent lateral side of the channel member. Following such an event, the first curtain must be detached from the nonadjacent lateral side of the channel member and raised above the point at which the initial detachment occurred so that the curtains may be lowered along their intended paths.

In an attempt to overcome the foregoing problem, the mating hook and loop fasteners on each curtain and corresponding lateral side of each channel member were (1) reduced in width and (2) the mating hook and loop fasteners on one lateral side of a channel member were offset from the mating hook and loop fasteners on the opposite lateral side of the channel member. Thus, if the first curtain was detached from its adjacent lateral side of a channel member, it was prevented from attaching to the nonadjacent lateral side of the channel member because the loop fastener on the first curtain did not align with the hook fastener on the nonadjacent lateral side of the channel member. Although these modifications greatly reduced curtain hang up, other problems arose. Specifically, the reduced width of the mating hook and loop fasteners led to a less secure seal. Also, if a curtain was slightly misaligned with the lateral side of a channel member, the reduced width of the mating hook and loop fasteners sometimes led to inadequate overlap and, consequently, insufficient sealing between the mating hook and loop fasteners. This sometimes also resulted in creases forming in the curtains, which if recurrent, reduced the life of the curtains.

Accordingly, what is needed is an apparatus that overcomes the foregoing problems and allows each longitudinal side of each curtain to become sealably attached to only the adjacent lateral side of each channel member.

SUMMARY OF THE INVENTION

In view of the foregoing disadvantage inherent in sealable curtain systems utilizing hook and loop fastening material, the present invention provides an improved dual curtain closure system wherein the same is able to form a sealing engagement between each longitudinal side of a sealable curtain and the adjacent lateral side of each channel member, while resisting forming a sealing engagement between the longitudinal side of the curtain and the nonadjacent lateral side of each channel member. To attain this, the preferred embodiment of the present invention is a sealable curtain system having two flexible covers or curtains selected from a material suitable to affect the type of closure sought. For example, if the closure is to allow ventilation but obstruct light, the material of the curtain would be of a weave that would be permeable to air but block a certain amount of light. Similarly, the closure could be impervious to moisture yet permeable to air, or vapor proof yet transparent, or opaque and vapor proof as the needs of the building on which the closure is used require.

The curtains are at least as wide as the portal opening to be covered and are longer than the height of the opening. The curtains are sealed by means of hook and loop fastening material, such that each lateral margin of each curtain has a strip of loop fastening material affixed thereto, and a complementary strip of hook fastening material is affixed to the inside of the adjacent lateral side of the adjacent channel member. The hook fastening material has only downwardly facing hooks. The top end of each curtain is rigidly affixed across the top of the portal opening. The opposite ends of the curtains are upturned and connected to a driven take-up roller mounted above the portal opening, thus forming a pocket in each curtain. Two elongated rods extend lengthwise through the pockets and across the portal opening, thus each elongated rod is supported within a pocket of one curtain with the ends of the elongated rod captured within the channel members. The rods are maintained at different heights relative to each other. Activation of the driven take-up roller lengthens or shortens the effective length of the curtains and moves the rods upwardly or downwardly within the channels such that the mating hook and loop fasteners are positioned to seal and unseal the curtains to the channel members.

DETAILED DESCRIPTION OF THE INVENTION

Figure 1:
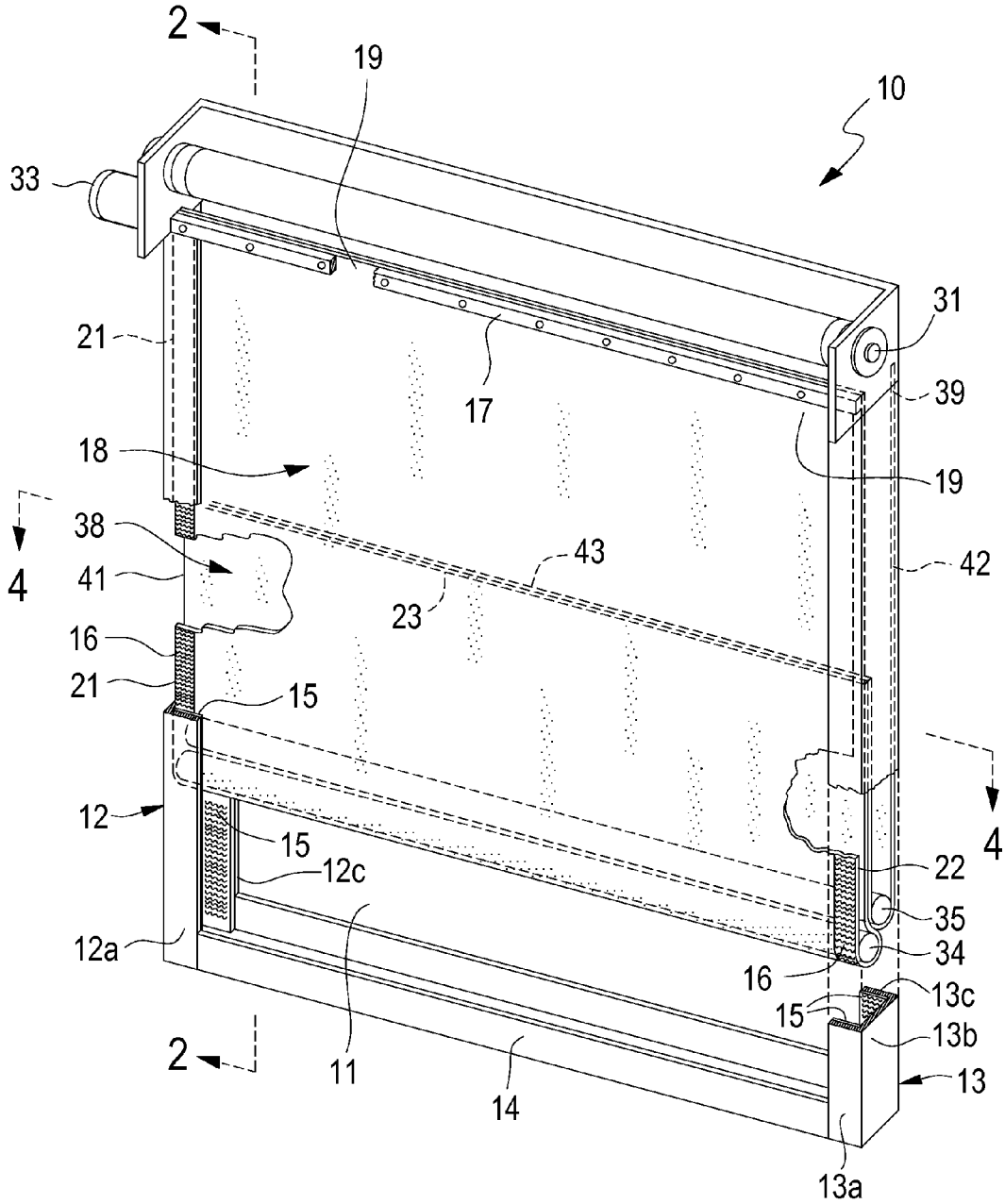
FIG. 1 is a front perspective view of the present invention shown partially in section.
Figure 4:
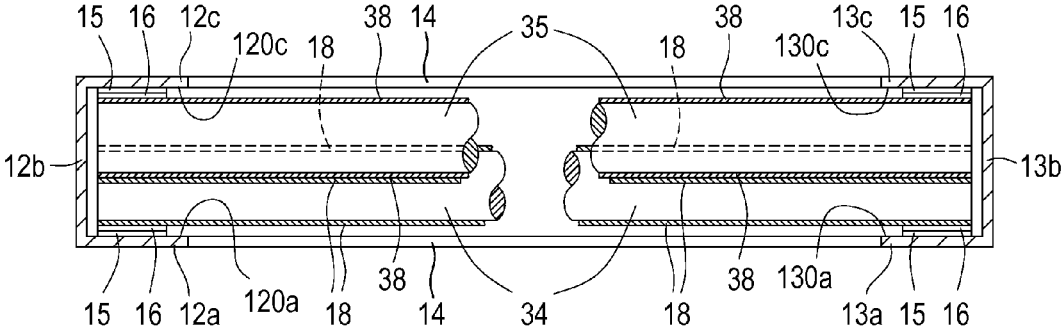
FIG. 4 is a top sectional view of the invention taken along line 4-4 of FIG. 1.
Figure 5:
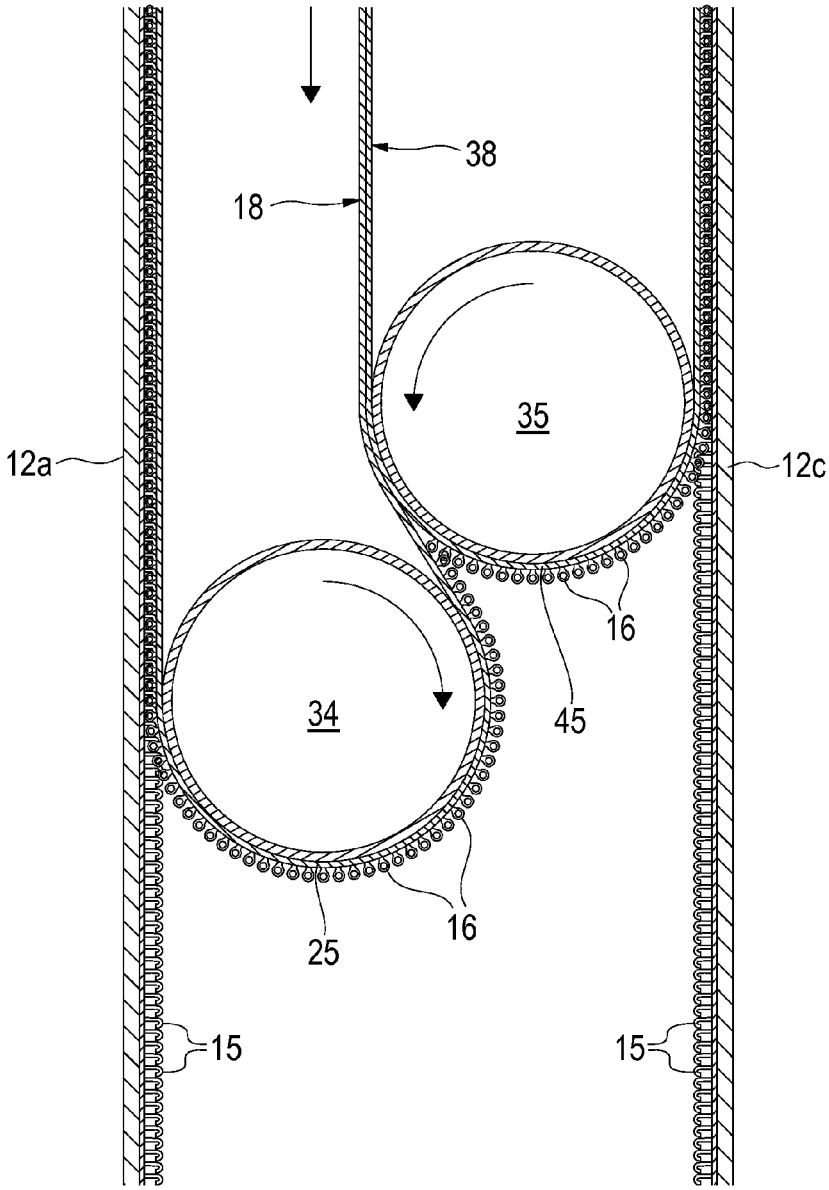
FIG. 5 is an enlarged side sectional view of the invention showing the curtains being lowered.
Figure 6:
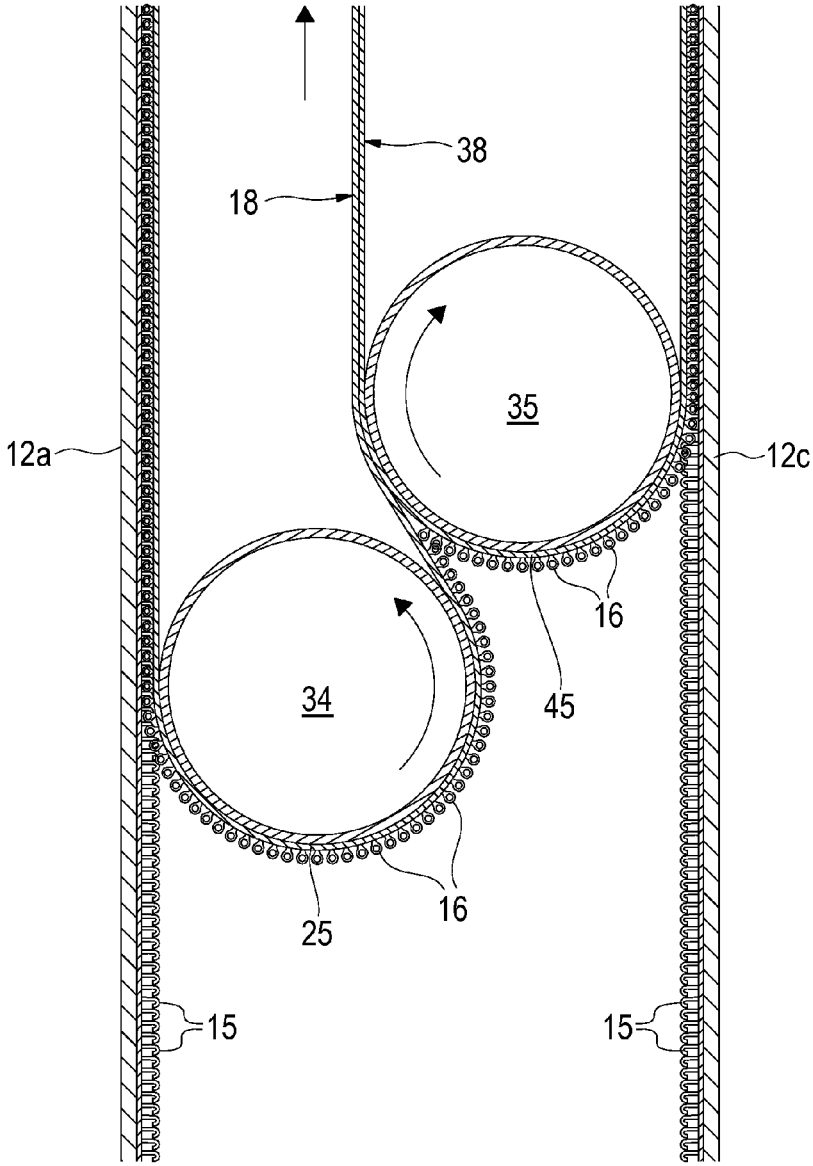
FIG. 6 is an enlarged side sectional view of the invention showing the curtains being raised.
Figure 7:
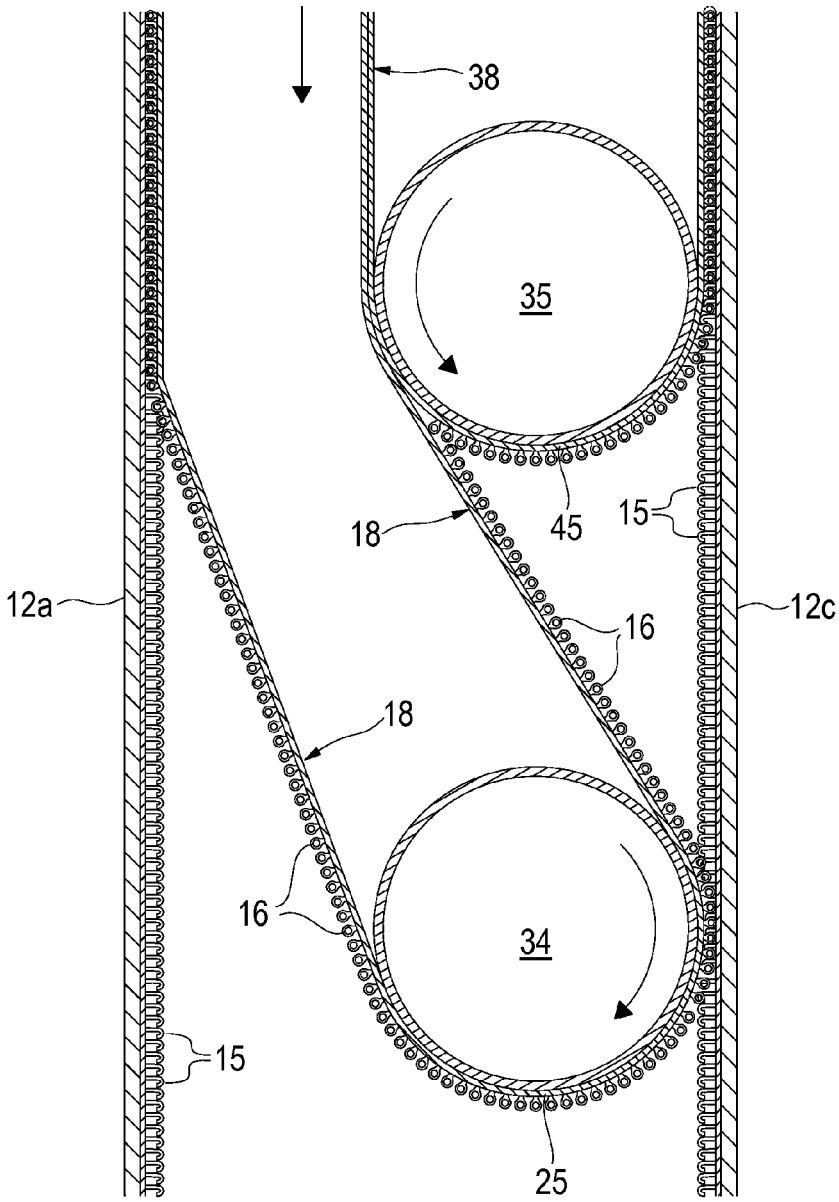
FIG. 7 is an enlarged side sectional view of the invention showing the lower curtain partially detached from its adjacent lateral side of the channel member and contacting the nonadjacent lateral side of the channel member.

The preferred apparatus of the dual curtain closure system is indicated generally by the numeral 10. As best shown in FIG. 1, the apparatus 10 has first 12*a*, second 12*c*, third 13*a*, and fourth 13*c* attachment members. The attachment members 12*a*, 12*c*, 13*a*, 13*c* each extend the full vertical length of the portal opening 11 to be covered and each terminate at a lower end 14, which may be, for example, a floor or an upwardly opening channel member which extends across the width of the opening 11. The attachment members 12*a*, 12*c*, 13*a*, 13*c* are positioned in pairs such that the first 12*a* and second 12*c* attachment members define one lateral margin of the opening 11 and the third 13*a* and fourth 13*c* attachment members define the opposing lateral margin of the opening 11. The distance between the first 12*a* and second 12*c* attachment members is preferably equal to the distance between the third 13*a* and fourth 13*c* attachment members. As best shown in FIG. 4, each attachment member 12*a*, 12*c*, 13*a*, 13*c* has an inner surface 120*a*, 120*c*, 130*a*, 130*c* and the inner surfaces of each pair of attachment members preferably face one another. Preferably, each pair of attachment members is part of a channel member, such that the apparatus 10 has first 12 and second 13 channel members. The first channel member 12 preferably has first 12*a* and second 12*c* attachment members as well as a perpendicular member 12*b* attached therebetween and the second channel member 13 likewise preferably has third 13*a* and fourth 13*c* attachment members as well as a perpendicular member 13*b* attached therebetween. Each perpendicular member 12*b*, 13*b* is preferably substantially orthogonal to both attachment members attached thereto such that each channel member 12, 13 is cross-sectionally substantially C-shaped. Each channel member 12, 13 is preferably directed inwardly such that the channels formed by the C-shaped channel members 12, 13 face one another. The channel members 12, 13 and lower end 14 are preferably made of a durable material capable of resisting wear, such as metal.

The apparatus 10 has a first brace or bar 17 and second brace or plate 37. Each brace 17, 37 preferably extends across the width of the opening 11 and is mounted superjacent the opening 11. Each brace 17, 37 has opposing ends, each of which is preferably attached to a channel member 12, 13. The braces 17, 37 are preferably made of metal for increased durability. Attached to the first brace 17 is a first end 19 of a first curtain 18 and attached to the second brace 37 is a first end 39 of a second curtain 38. Each curtain 18, 38 is preferably a flexible material selected in accordance with the purposes of the present invention for the ability of the curtain 18, 38 to block or transmit light, air, or moisture from one side of the curtain 18, 38 to the other. The length of each curtain 18, 38 is preferably greater than the length of the lateral margins of the opening 11 such that each curtain 18, 38 is capable of covering the entire opening 11. The first curtain 18 has first 21 and second 22 longitudinal sides and the second curtain 38 has first 41 and second 42 longitudinal sides with the first longitudinal side 21, 41 of each curtain 18, 38 positioned along the same lateral margin as the first channel member 12 and with the second longitudinal side 22, 42 of each curtain 18, 38 positioned along the same lateral margin as the second channel member 13. Each curtain 18, 38 has an interior surface 18*a*, 38*a* and an exterior surface 18*b*, 38*b*. When the curtains 18, 38 are in a lowered position, the interior surfaces 18*a*, 38*a* preferably face one another and the exterior surfaces 18*b*, 38*b* preferably face away from the opening 11.

Each longitudinal side 21, 22, 41, 42 of each exterior surface 18*b*, 38*b* of each curtain 18, 38 is releasably attachable to one attachment member 12*a*, 12*c*, 13*a*, 13*c*. Specifically, the first longitudinal side 21 of the exterior surface 18*b* of the first curtain 18 is releasably attachable to the first attachment member 12*a*, the second longitudinal side 22 of the exterior surface 18*b* of the first curtain 18 is releasably attachable to the third attachment member 13*a*, the first longitudinal side 41 of the exterior surface 38*b* of the second curtain 38 is releasably attachable to the second attachment member 12*c*, and the second longitudinal side 42 of the exterior surface 38*b* of the second curtain 38 is releasably attachable to the fourth attachment member 13*c*. The releasable attachments of the longitudinal sides 21, 22, 41, 42 to the attachment members 12*a*, 12*c*, 13*a*, 13*c* are achieved through hook and loop fastening material. Each attachment member 12*a*, 12*c*, 13*a*, 13*c* has hook fastening material 15 affixed to the inner surface 120*a*, 120*c*, 130*a*, 130*c* thereof. Affixed to each longitudinal side 21, 22, 41, 42 is loop fastening material 16 complementary to the hook fastening material 15 affixed to the attachment members 12*a*, 12*c*, 13*a*, 13*c*. The attachment of loop fastening material 16 to each longitudinal side 21, 22, 41, 42 is preferably along, or in the alternative relatively near, the lateral edges of the curtains 18, 38.

Figure 2:
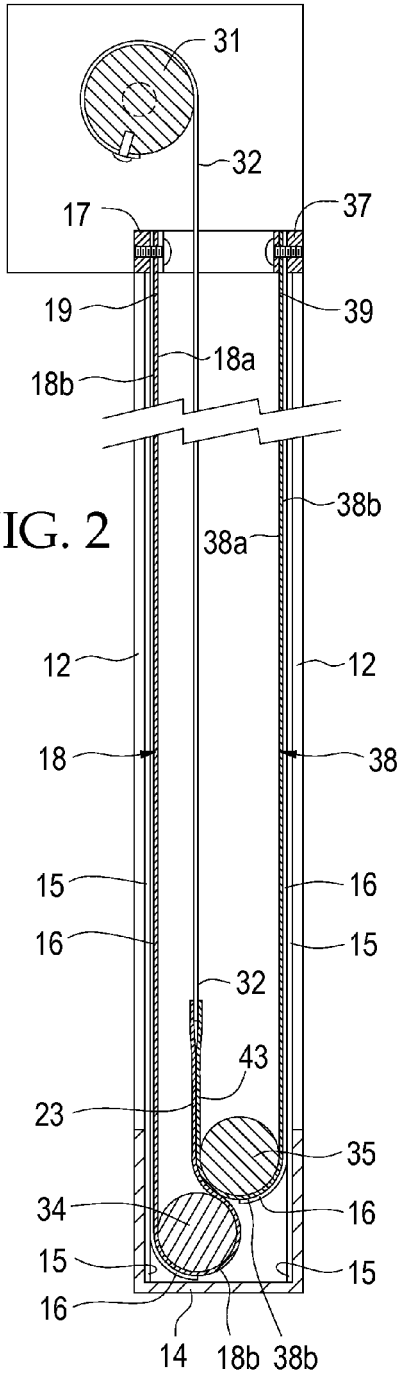
FIG. 2 is a side sectional view of the invention taken along line 2-2 of FIG. 1 with the curtains shown in a lowered position.
Figure 3:
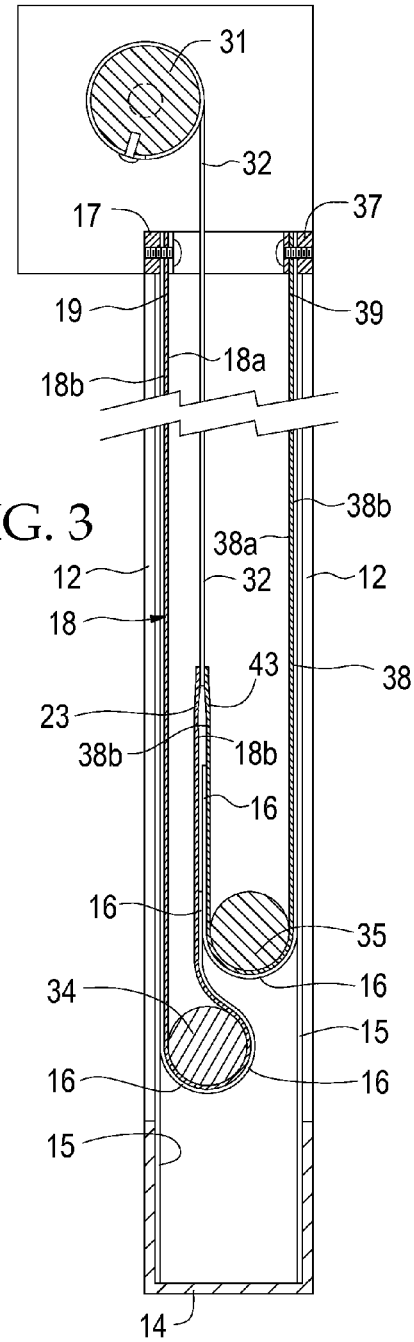
FIG. 3 is a side sectional view of the invention of FIG. 2 with the curtains shown in a partially raised position.

The first curtain 18 has a second end 23 opposite the first end 19 and the second curtain 38 has a second end 43 opposite the first end 39. As best shown in FIGS. 2-3 and 5-7, each second end 23, 43 is upturned such that each curtain 18, 38 has an upwardly opening pocket 25, 45 formed therein. Supported within the pocket 25 of the first curtain 18 is a first elongated rod 34 and supported within the pocket 45 of the second curtain 38 is a second elongated rod 35. As is best shown in FIG. 2, even when the first rod 34 is substantially at its bottommost position, the second ends 23, 43 preferably remain upturned. Therefore, it can be appreciated that the second ends 23, 43 preferably never separate from one another and therefore are preferably attached to each other, such as by being sewn together. The height of the second ends 23, 43 is adjustable. As best shown in FIGS. 2-3, the height of the second ends 23, 43 determines the area of the opening 11 covered by the curtains 18, 38. The attached second ends 23, 43 are preferably connected to a transverse take-up roller or spindle 31 mounted superjacent the opening 11. The spindle 31 is preferably driven by a reversible motor 33 attached to a selected means of control. The attached second ends 23, 43 are preferably attached to a common take-up curtain 32 which is in turn attached to the spindle 31. Alternatively, the second ends 23, 43 of each curtain may be directly attached to the spindle 31. As the spindle 31 rotates, the take-up curtain 32 either wraps around or unwraps from the spindle 31, altering the effective length of the take-up curtain 32 and thus the height of the attached second ends 23, 43. The spindle 31 is preferably made of metal or durable plastic.

As noted above, supported within the pocket 25 of the first curtain 18 is a first elongated rod 34 and supported within the pocket 45 of the second curtain 38 is a second elongated rod 35. Each elongated rod 34, 35 extends across the width of the opening 11 and is preferably at least as long as the second end of each curtain 18, 38. The rods 34, 35 are preferably of equal size, shape, and material, preferably each made of solid or tubular pipe made of a durable material such as metal or fiberglass, which may be covered with flexible foam for safety. Preferably, the opposing ends of each elongated rod 34, 35 are captured within the channel members 12, 13 such that the rods 34, 35 are capable of rolling vertically within the channel members 12, 13 but are not capable of substantial movement in the horizontal plane. As best shown in FIGS. 2-3, the distance between the attachment members 12*a*, 12*c*, 13*a*, 13*c* of each channel member 12, 13 is preferably less than twice the diameter of each elongated rod 34, 35 such that the elongated rods 34, 35 may be positioned such that the second rod 35 is maintained at a height greater than the height of the first elongated rod 34. As the spindle 31 rotates so that the take-up curtain 32 is unrolled therefrom, the height of the second ends 23, 43 is lowered, thereby lowering the pockets 25, 45 and elongated rods 34, 35 to allow the curtains 18, 38 to cover the opening 11. As the curtains 18, 38 are lowered to cover a larger area of the opening 11, the lowering elongated rods 34, 35 roll along the inside surfaces 18*a*, 38*a* of the curtains 18, 38 and urge the curtains 18, 38 against the attachment members 12*a*, 12*c*, 13*a*, 13*c*. This force applied against the longitudinal sides 21, 22, 41, 42 of the exterior surfaces 18*b*, 38*b* pushes the loop fastening material 16 affixed thereto into the hook fastening material 15 affixed to the attachment members 12*a*, 12*c*, 13*a*, 13*c*, thus causing a secure attachment between the curtains 18, 38 and the channel members 12, 13.

As best shown in FIG. 3, because the second end 23, 43 of each curtain is upturned, the interior surface 18*a* of the first curtain is divided into two segments which face one another, while the segments of the exterior surface 18*b* face away from one another. Therefore, the upturned portion of the first longitudinal side 21 of the exterior surface 18*b* of the first curtain 18 faces the inner surface 120*c* of the second attachment member 12*c*. Likewise, the upturned portion of the second longitudinal side 22 of the exterior surface 18*b* of the first curtain 18 faces the inner surface 130*c* of the fourth attachment member 13*c*. While most of the exterior surface 18*b* of the first curtain 18 is separated from the second 12*c* and fourth 13*c* attachment members by the second curtain 38, because the second elongated rod 35 is maintained at a height greater than the first elongated rod 34, the lowest upturned portion of the exterior surface 18*b* of the first curtain 18, which abuts the first elongated rod 34, does not have such separation. When the first curtain 18 is at least partially raised, this portion lacking separation has loop fastening material 16 affixed thereto. To prevent the hook fastening material 15 affixed to the second 12*c* and fourth 13*c* attachment members from engaging the loop fastening material 16 affixed to the exterior surface 18*b* of the first curtain 18, the hook fastening material 15 affixed to the second 12*c* and fourth 13*c* attachment members, and more preferably also to the first 12*a* and third 13*a* attachment members, is comprised entirely of downwardly facing hooks 15, shown in FIGS. 5-7. A suitable hook for the hook fastening material is disclosed in U.S. Pat. No. 4,984,339 to Provost et al., incorporated herein by reference.

Hook and loop fastening material is well known in the art (e.g. VELCRO®). The hook fastening material is made of a plurality of small hooks preferably comprising nylon or polyester, most preferably extruded polyester for ultra-violet resistance, and the loop fastening material is made of a plurality of small loops preferably comprising nylon or polyester, most preferably nylon for strength. When the two materials are abutted, the small hooks of the hook fastening material engage the small loops of the loop fastening material. This interlocking of the small hooks with the small loops causes the fastening materials to form a secure attachment. Hook fastening material is typically made of multi-directional hooks that face in a plurality of directions, such as upwardly and downwardly. However, for the reasons explained below, the use of multi-directional hooks in the present dual curtain system is problematic.

In the event of an external force against the first curtain 18 whereby the pocket 25 of the first curtain 18, with enclosed rod 34, detaches from the first 12*a* and third 13*a* attachment members and makes contact with the second 12*c* and fourth 13*c* attachment members (see FIG. 7), the contact between the loop fastening material 16 affixed to the first curtain 18 and the hook fastening material 15 affixed to the second 12*c* and fourth 13*c* attachment members would typically be momentary but for the engagement of the fastening materials 15, 16. Through experimentation it has been determined that, where the hook fastening material is made of multi-directional hooks, the multi-directional hooks tend to engage the loop fastening material even on such momentary contact and hang up the curtain. The curtain must then be raised to a position above the hang up location and lowered again. However, experimentation has shown that this momentary contact is insufficient for hook fastening material made of only downwardly facing hooks to attach to the loop fastening material. Instead, the loop fastening material tends to bounce off or roll off the downwardly facing hooks and, consequently, the first curtain 18 will return to its proper position.

In addition, the attempt to address the hang up problem discussed in the "Background of the Invention" section whereby the mating hook and loop fasteners on each curtain and corresponding lateral side of each channel member were (1) reduced in width and (2) the mating hook and loop fasteners on one lateral side of a channel member were offset from the mating hook and loop fasteners on the opposite lateral side of the channel member becomes completely unnecessary with the use of only downwardly facing hooks of the present invention. Thus, the width of the mating hook and loop fasteners can be maximized (e.g., greater than two-fold the reduced hook and loop fastener width design discussed above) to create more hook and loop overlap and thus a more secure seal, and to avoid creases forming in the curtains. As a result, the present invention promotes a far superior seal and extends the life of the curtains in addition to the life of the hook and loop fastening material.

While the downwardly facing hooks 15 affixed to the inner surface 120*c*, 130*c* of each of the second 12*c* and fourth 13*c* attachment members of the present invention resist engaging the loop fastening material 16 affixed to the first curtain 18 based on momentary contact, it has been determined that the present invention achieves a sufficient seal between the downwardly facing hooks 15 affixed to the second 12*c* and fourth 13*c* attachment members and the loop fastening material 16 affixed to the second curtain 38. The sufficiency of this seal is due to a longer period of contact between the loop fastening material 16 and the downwardly facing hooks 15, as the loop fastening material 16 affixed to the second curtain 38 is unrolled adjacent to the downwardly facing hooks 15 and the loop fastening material 16 is pushed into the downwardly facing hooks 15 by the second elongated rod 35. The downwardly facing hooks 15 allow the complementary loop material 16 to roll into the hook material 15 as the curtains 18, 38 are lowered, thereby sealing the curtains 18, 38 to the channel members 12, 13. When the curtains 18, 38 are raised, the loop material 16 rolls out of the hook material 15. Because the loop material 16 is rolled out, tearing of the loops is minimized. Consequently, additional benefits of using hook and loop fastening material having only downwardly facing hooks 15 is that the life of the hook and loop fastening material is greatly increased (e.g., ten-fold) over hook and loop fastening material having multi-directional hooks, and the noise associated with the loop material 16 detaching from the hook material 15 is greatly reduced, which may be critical in environments requiring low noise.

While only one form of the invention has been shown, it will be obvious to those skilled in the art that it is not so limited, but is susceptible of various changes and modifications without departing from the spirit thereof. For example, the hook fastening material 15 can be affixed to a "floating" edge of flexible material attached at one end to the first and second channel members 12, 13, as is disclosed in U.S. Pat. No. 6,138,739 to Crider et al., incorporated herein by reference.

The invention claimed is:

1. A dual curtain closure system for covering a portal, comprising:

a. first and second pairs of attachment members, wherein said first pair comprises first and second attachment members and said second pair comprises third and fourth attachment members, wherein said first and second pairs of attachment members define lateral margins of the portal, and wherein each of said attachment members has an inner surface substantially parallel to a plane of the portal, said inner surface of said first attachment member substantially facing said inner surface of said second attachment member and said inner surface of said third attachment member substantially facing said inner surface of said fourth attachment member;

b. hook fastening material attached to said inner surface of each of said attachment members;

c. first and second curtains, wherein the length of each of said curtains is greater than the length of said lateral margins of the portal, wherein each of said curtains has first and second elongated side portions, wherein each of said curtains has a first and second end each having a dimension commensurate with the separation of said pairs of attachment members, wherein each of said curtains has an interior surface and an exterior surface, wherein when said curtains are in a lowered position said interior surfaces of said curtains substantially face one another and said exterior surfaces of said curtains face away from the portal, and wherein said first end of each of said curtains is fixedly attached across the portal at an upper end thereof and said second end of each of said curtains is folded back on itself to define an upwardly opening pocket;

d. means for urging said second end of each of said curtains along a vertical path such that the heights of said pockets are adjustable;

e. loop fastening material attached to said exterior surface of each of said curtains along each of said elongated side portions, wherein said loop fastening material is complementary to and capable of being secured by said hook fastening material;

f. a first elongated rod supported within said pocket of said first curtain, wherein the length of said first rod is approximately at least as great as the distance between said loop fastening material attached to said first elongated side portion of said first curtain and said loop fastening material attached to said second elongated side portion of said first curtain; and g. a second elongated rod supported within said pocket of said second curtain, wherein the length of said second rod is approximately at least as great as the distance between said loop fastening material attached to said first elongated side portion of said second curtain and said loop fastening material attached to said second elongated side portion of said second curtain, and wherein said second rod is maintained at a height greater than said first rod;

h. wherein said hook fastening material attached to said inner surface of said second and fourth attachment members has only downwardly facing hook openings to prevent said hook fastening material attached to said inner surface of said second and fourth attachment members from engaging said loop fastening material attached to said exterior surface of said first curtain as said first curtain and said first elongated rod supported within said pocket of said first curtain are lowered.

2. A dual curtain closure system according to claim 1 wherein said urging means comprises a driven roller mounted superjacent the portal cooperatively connected to said upturned end of each of said first and second curtains.

3. A dual curtain closure system according to claim 1 further comprising first and second channel members, wherein said first channel member comprises said first attachment member attached substantially orthogonally to a first perpendicular member attached substantially orthogonally to said second attachment member, and wherein said second channel member comprises said third attachment member attached substantially orthogonally to a second perpendicular member attached substantially orthogonally to said fourth attachment member.

4. A dual curtain closure system according to claim 3 wherein said first and second channel members engage the lateral ends of said first and second rods, and wherein said first and second rods are capable of rolling vertically within said channel members.

5. A dual curtain closure system for covering a portal, comprising:

a. a pair of spaced apart opposing channel members defining lateral margins of the portal, wherein said channel members comprise a first channel member having a first attachment member attached substantially orthogonally to a first connecting member attached substantially orthogonally to a second attachment member, and a second channel member having a third attachment member attached substantially orthogonally to a second connecting member attached substantially orthogonally to a fourth attachment member;

b. a first curtain having a length greater than the length of said lateral margins of the portal, elongated side portions, a first end and a second end each having a dimension commensurate with the separation of said channel members, with said first end being fixedly attached across said portal at an upper end thereof, said second end folded back on itself to define an upwardly opening pocket;

c. a second curtain having a length greater than the length of said lateral margins of the portal, elongated side portions, a first end and a second end each having a dimension commensurate with the separation of said channel members, with said first end being fixedly attached across said portal at an upper end thereof, said second end folded back on itself to define an upwardly opening pocket;

d. a first elongated rod supported within said pocket of said first curtain, and having opposing ends captured within said opposing channel members;

e. a second elongated rod supported within said pocket of said second curtain, and having opposing ends captured within said opposing channel members, wherein said second rod is maintained at a height greater than said first rod;

f. means for urging said second ends of said curtains along a vertical path such that the heights of said pockets are adjustable;

g. hook fastening material affixed to each of said attachment members; and h. loop fastening material affixed to each of said elongated side portions of each of said curtains;

i. wherein said loop fastening material affixed to said elongated side portions of said first curtain is complementary to and capable of being releasably attached to said hook fastening material affixed to said first and third attachment members, and wherein said loop fastening material affixed to said elongated side portions of said second curtain is complementary to and capable of being releasably attached to said hook fastening material affixed to said second and fourth attachment members; and j. wherein said hook fastening material affixed to said second and fourth attachment members has only downwardly facing hook openings to prevent said hook fastening material affixed to said second and fourth attachment members from engaging said loop fastening material affixed to said elongated side portions of said first curtain as said first curtain and said first elongated rod supported within said pocket of said first curtain are lowered.

6. A dual curtain closure system according to claim 5 wherein said urging means comprises a driven roller mounted superjacent the portal cooperatively connected to said second ends of said curtains.

7. A dual curtain closure system according to claim 5 wherein a leading edge of said second end of said second curtain is attached to a leading edge of said second end of said first curtain.

8. A dual curtain closure system for covering a portal, comprising:

a. a pair of spaced apart opposing channel members defining lateral margins of the portal, wherein said channel members comprise a first channel member having a first attachment member and an opposing second attachment member, wherein said channel members further comprise a second channel member having a third attachment member and an opposing fourth attachment member;

b. a first curtain having a length greater than the length of said lateral margins of the portal, elongated side portions, a first end and a second end each having a dimension commensurate with the separation of said channel members, with said first end being fixedly attached across said portal at an upper end thereof, said second end folded back on itself to define an upwardly opening pocket;

c. a second curtain having a length greater than the length of said lateral margins of the portal, elongated side portions, a first end and a second end each having a dimension commensurate with the separation of said channel members, with said first end being fixedly attached across said portal at an upper end thereof, said second end folded back on itself to define an upwardly opening pocket;

d. a first elongated rod supported within said pocket of said first curtain, and having opposing ends captured within said opposing channel members;

e. a second elongated rod supported within said pocket of said second curtain, and having opposing ends captured within said opposing channel members, wherein said second rod is maintained at a height greater than said first rod;

f. means for urging said second ends of said curtains along a vertical path such that the heights of said pockets are adjustable;

g. hook fastening material affixed to each of said attachment members; and h. loop fastening material affixed to each of said elongated side portions of each of said curtains;

i. wherein said loop fastening material affixed to said elongated side portions of said first curtain is complementary to and capable of being releasably attached to said hook fastening material affixed to said first and third attachment members, and wherein said loop fastening material affixed to said elongated side portions of said second curtain is complementary to and capable of being releasably attached to said hook fastening material affixed to said second and fourth attachment members; and j. wherein said hook fastening material affixed to said second and fourth attachment members has only downwardly facing hook openings to prevent said hook fastening material affixed to said second and fourth attachment members from engaging said loop fastening material affixed to said elongated side portions of said first curtain as said first curtain and said first elongated rod supported within said pocket of said first curtain are lowered.

9. A dual curtain closure system according to claim 8 wherein said urging means comprises a driven roller mounted superjacent the portal cooperatively connected to said second ends of said curtains.

10. A dual curtain closure system according to claim 8 wherein a leading edge of said second end of said second curtain is attached to a leading edge of said second end of said first curtain.

* * * * *